US007128519B2

(12) United States Patent
Yin

(10) Patent No.: US 7,128,519 B2
(45) Date of Patent: Oct. 31, 2006

(54) AUTO STACKING MACHINE FOR STRIP ARTICLES

(75) Inventor: Chia Pin Yin, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 222 days.

(21) Appl. No.: 10/843,284

(22) Filed: May 10, 2004

(65) Prior Publication Data

US 2004/0247425 A1 Dec. 9, 2004

(30) Foreign Application Priority Data

May 9, 2003 (TW) ..... 92208545 U

(51) Int. Cl.
*B65H 31/30* (2006.01)

(52) U.S. Cl. ..... 414/790.4; 414/788.9; 414/789.6; 414/789.7; 414/790.7; 414/802; 193/25 FT

(58) Field of Classification Search ..... 414/790.4, 414/790.7, 789.7, 789.6, 788.9, 789, 789.9, 414/224, 675, 802; 221/289, 290, 294, 296; 193/25 FT See application file for complete search history.

(56) References Cited

U.S. PATENT DOCUMENTS 3,240,314 A * 3/1966 Griner ..... 198/458
3,708,860 A * 1/1973 Bolster et al. ..... 29/430
4,677,283 A * 6/1987 Lewis ..... 235/98 C
5,027,938 A * 7/1991 Haggarty et al. ..... 198/358
5,489,019 A * 2/1996 DiNanno et al. ..... 198/752.1
5,503,514 A * 4/1996 LaManna et al. ..... 101/23
5,579,894 A * 12/1996 Glazier et al. ..... 198/431
5,720,593 A * 2/1998 Pleake ..... 414/789.9
5,973,285 A * 10/1999 Dietrich et al. ..... 209/573
6,695,571 B1 * 2/2004 Canella ..... 414/801
6,834,755 B1 * 12/2004 Jay ..... 198/418.6

* cited by examiner

*Primary Examiner*—Douglas A. Hess
(74) *Attorney, Agent, or Firm*—Wei Te Chung

(57) ABSTRACT

An auto stacking machine includes a worktable (10), a plurality of chutes (20), a pair of receivers (30), and a cushioning apparatus. Three vertical plates (14) are mounted on the worktable. The chutes are attached to outmost ones of the vertical plates respectively, for receiving slot covers (60). The cushioning apparatus includes a plurality of resilient members (55) positioned behind corresponding slideways, for cushioning the dropping strip articles. Each receiver includes a number of receiving spaces, for receiving and stacking the strip articles therein. The receivers are attached to the worktable, and are horizontally moveable. A controller is arranged under the worktable, for electrically controlling movement of the receivers to switch positions of the receiving spaces.

16 Claims, 2 Drawing Sheets

AUTO STACKING MACHINE FOR STRIP ARTICLES

BACKGROUND OF THE INVENTION

1. Field of the Invention

The present invention relates to a stacking machine, and more particularly to a stacking machine for automatically stacking strip articles.

2. Description of the Related Art

Microprocessor based computer systems typically require or include facilities for connecting one or more expansion cards to the system. Expansion cards extend the capabilities of computer systems by providing dedicated hardware to achieve a variety of tasks. These expansion cards comprise graphics adapters, high speed network controllers, hard disk controllers, sound cards, and modem cards, etc.

A typical expansion card comprises a printed circuit board electrically connected to the computer system, and a slot cover attached to the printed circuit board and mechanically attached to the computer system. The slot cover is usually punched from a piece of metal plate via a punch. As a matter of fact, sites for producing slot covers, and assembling expansion cards are often different. The slot covers have to be primarily packed for facilitating conveyance from one site to another. Usually, many people are occupied for manual collecting and packing the slot covers. However, the punch usually produces 8000 pieces of slot covers per hour. It is extremely difficult for people to keep pace with the punch. Additionally, manual operation is unduly laborious and inefficient.

Thus, an auto stacking machine which overcomes the above-mentioned problems is desired.

SUMMARY OF THE INVENTION

Accordingly, an object of the present invention is to provide an auto stacking machine which does not require laborious manual operation and has greater efficiency.

Another object of the present invention is to provide an auto stacking machine which is used to orderly stack strip articles together.

To achieve the above objects, an auto stacking machine in accordance with the present invention comprises a worktable, a plurality of slideways, a pair of receivers, and a cushioning apparatus. Three vertical plates are mounted on said worktable. The slideways are attached to side ones of the vertical plates respectively, for receiving strip articles. The cushioning apparatus comprises a plurality of resilient members positioned behind corresponding slideways for cushioning the strip articles from the slideways. Each receiver defines a plurality of receiving spaces, for collecting and stacking the strip articles from the slideways. The receivers are attached to the worktable, and are moveable with respect to the slideways. A controller is arranged under the worktable, for electrically controlling movement of the receivers to switch positions of the receiving spaces. In use, when strip articles that are stacked in the receiving spaces under the slideway reach predetermined number, the controller controls the receivers to move empty receiving spaces in alignment with the slideways instead of said receiving spaces full of strip articles.

Other objects, advantages and novel features of the present invention will be drawn from the following detailed description of preferred embodiments of the present invention with the attached drawings, in which:

DETAILED DESCRIPTION OF THE INVENTION

Figure 1:
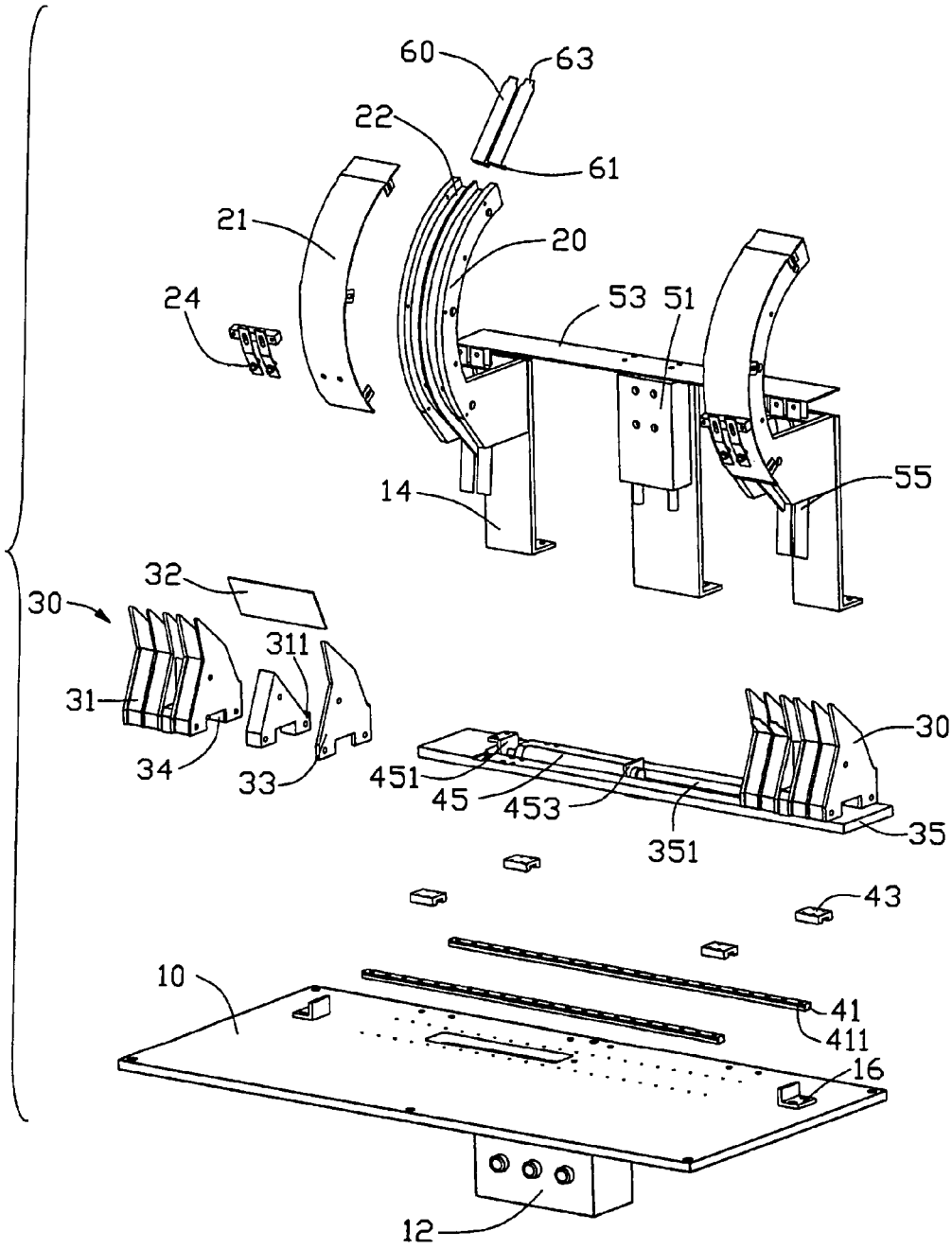
FIG. 1 is an exploded, isometric view of an auto stacking machine in accordance with a preferred embodiment of the present invention.
Figure 2:
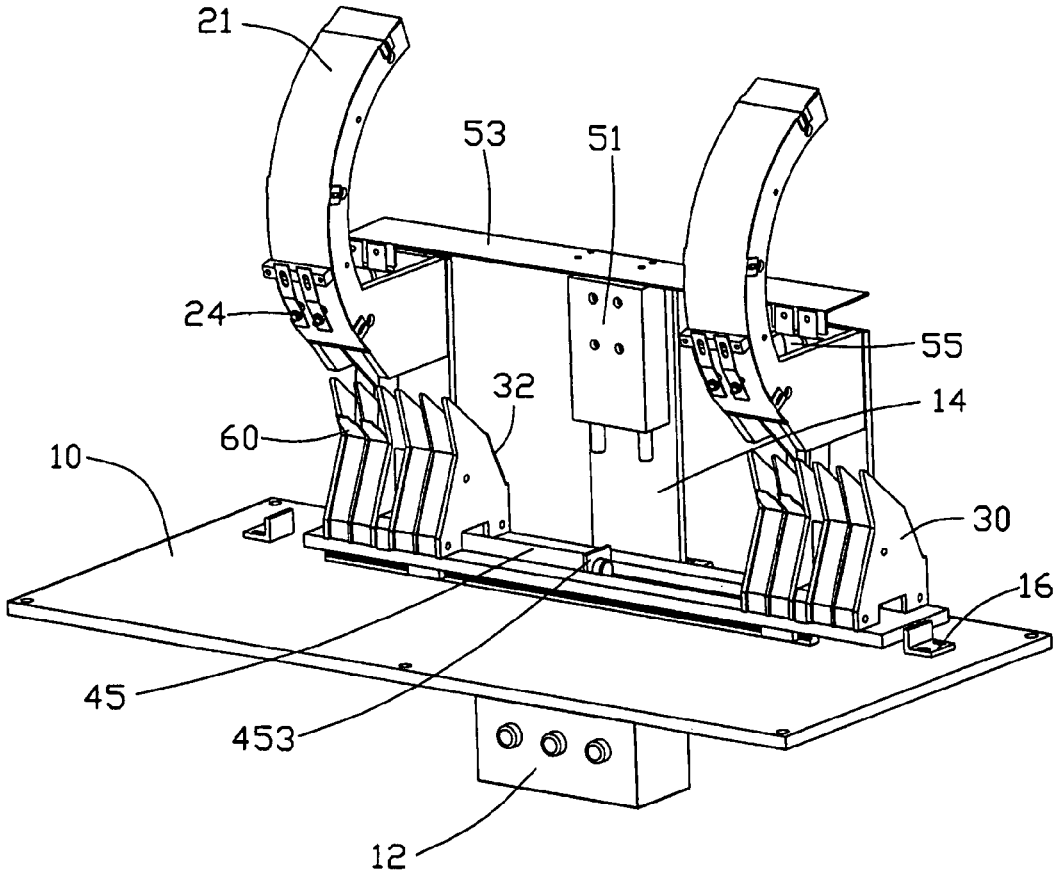
FIG. 2 is an assembled view of FIG. 1.

Referring to FIGS. 1 and 2, an auto stacking machine in accordance with a preferred embodiment of the present invention is provided to automatically stack strip articles, such as slot covers 60. Each slot cover 60 is produced by a punch (not shown), and comprises an end section 63 and a bent section 61 opposing the end section 63. The stacking machine comprises a worktable 10, a pair of curved chutes 20, a pair of receivers 30, and a cushioning apparatus.

A controller 12 is attached to an underside of the worktable 10, and in the preferred embodiment of the present invention the controller is a programmable logic controller. Three spaced vertical plates 14 are mounted on a rear portion of the worktable 10.

The chutes 20 are respectively mounted to two outmost vertical plates 14. Each chute 20 defines two curved slideways 22 for the slot covers 60 sliding therealong. The number of the slideways 22 may be changed according to the number of die outlets (not shown) of the punch. Entrances of the slideways 22 are coupled with the die outlets, for receiving the slot covers 60. The slideways 22 are covered with covers 21. The covers 21 are shorter than the slideways 22, such that bottom portions of the slideways 22 are exposed. A plurality of counters 24 is mounted to the covers 21, corresponding the slideways 22 respectively. Each counter 24 preferably comprises an optical sensor. Each counter 24 comprises two parts respectively attached to front and rear sides of the slideways 22 (only the front parts are visible). A beam of light exists between the two parts of each counter 24. Once one slot cover 60 passes between the two parts, the light connection of the counter 24 is interrupted, the counter 24 senses the light change, and automatically count the number of the slot cover 60. The counter 24 then sends the signal to the controller 12.

The receivers 30 are arranged corresponding to the slideways 22. The receivers 30 are attached to opposite ends of a support plate 35 respectively. Each receiver 30 comprises a plurality of blocks 31, a plurality of spacing plate 33, and a shield plate 32. The shield plate 32 is attached to a rear side of each receiver 30. Each block 31 is arranged between every two neighboring spacing plates 33. Each block 31 defines an inclined rear side, and a generally V-shaped cutout 311 is defined in a bottom of the rear side of the block 31, for receiving bent section 63 of the slot cover 60. A stack of slot covers 60 is to be formed in a receiving space defined by the inclined rear side of each block 31 incorporating two corresponding spacing plates 33 and the shield plate 32. Each receiver 30 defines an elongated passage 34 at an underside thereof.

The support plate 35 is slideably attached to the worktable 10 via sliding mechanism. The support plate 35 defines a slot 351 therein. The sliding mechanism comprises a pair of parallel rails 41 fixed onto the worktable 10, two pairs of U-shaped seats 43 attached to an underside of the support plate 35, and a cylinder 45. Each rail 41 defines a pair of grooves 411 at both sides thereof. The seats 43 are mated with the rails 41 in the grooves 411, and the seats 43 are slideable along the rails 41. The cylinder 45 is accommodated in the slot 351 of the support plate 35, with one end thereof connected to the support plate 35 via a first connecting member 451, and one opposite end thereof attached to the worktable 35 via a second connecting member 453. The cylinder 45 is electrically controlled by the controller 12 to actuate movement of the support plate 35 along the rails 41. A pair of stop members 16 is attached to the worktable 10 in the vicinity of opposite ends of the rails 41, for preventing further movement of the support plate 35.

The cushioning apparatus comprises a cylinder 51, a bridge 53 attached to a top of the cylinder 51, and two pairs of resilient members 55 respectively depending from opposite sides of the bridge 53. The cylinder 51 is attached to an upper portion of a middle one of the three vertical plates 14, and is electrically controlled by the controller 12. The resilient members 55 are positioned behind corresponding slideways 22, and extend into corresponding receiving spaces of the receivers 30 respectively.

In use, the entrances of the slideways 22 are coupled with the die outlets of the punch, the auto stacking machine is then started. Bent sections 61 of the slot covers 60 firstly enter the slideways 22, and the slot covers 60 slide downwardly along the slideways 22 because of gravity. During the sliding of the slot covers 60 in the slideways 22, the slot covers 60 gradually overturn because of the arcuate profile of the slideways 22. The counters 24 count the number of the dropped slot covers 60, and send the signal to the controller 12.

When the slot covers 60 slide out from the slideways 22, the bent sections 61 press the resilient members 55 rearwardly. After the bent sections 61 ride over the resilient members 55, and are seated in the cutouts 311, the resilient members 55 rebound to press the slot covers 60 toward the rear sides of the blocks 31.

When a preset number of slot covers 60 enter and pile up in the receivers 30, the controller 12 activates the cylinder 51 of the cushioning apparatus to drive the bridge 53 upwardly, thereby the resilient members 55 are withdrawn from the receivers 30. The controller 12 then controls the cylinder 45 to actuate movement of the support plate 35 along the rails 41, thereby the empty receiving spaces of the receivers 30 are in alignment with the slideways 22 instead of the receiving spaces full of slot covers 60. The slot covers 60 stacked in the full receiving spaces are then taken out for conveyance or further packaging.

Because the slot covers 60 are automatically collected and stacked in the receiving spaces of the receivers 30, it eliminates the cumbersome and time consuming manual operation, and thus improves efficiency.

In an alternative embodiment of the present invention, the three vertical plates 14 are integrated to form one vertical plate. In a further alternative embodiment of the present invention, an accelerator, such as a compressed air injector, can be mounted to the stacking machine, for increasing the sliding speed of the slot covers 60 in the slideways 22.

While the present invention has been illustrated by the description of the preferred embodiments thereof, and while the preferred embodiments have been described in considerable detail, it is not intended to restrict or in any way limit the scope of the appended claims to such detail. Additional advantages and modifications within the spirit and scope of the present invention will readily appear to those skilled in the art. Therefore, the present invention is not limited to the specific details and illustrative examples shown and described.

What is claimed is:

1. An auto stacking machine for strip articles, the auto stacking machine comprising:

a worktable, at least one plate being mounted on said worktable;

at least one slideway following a path along a single plane for receiving said strip articles, said slideway being mounted to said plate of said worktable;

at least one receiver defining a plurality of receiving spaces for collecting and stacking said strip articles from said slideway, said receiver being horizontally moveable; and a controller electrically controlling movement of the receiver to switch positions of said receiving spaces.

2. The auto stacking machine as claimed in claim 1, further comprising a plurality of rails attached on the worktable, and a support plate slideably attached to the rails, wherein said receiver is attached to said support plate.

3. The auto stacking machine as claimed in claim 2, wherein a slot is defined in said support plate, a cylinder is positioned with one end thereof being attached to said support plate and the other end thereof being attached to said worktable, and the cylinder is controlled to actuate movement of the support plate by the controller.

4. The auto stacking machine as claimed in claim 3, wherein a pair of stop members is arranged on the worktable adjacent ends of said rails respectively, for preventing further movement of said support plate.

5. The auto stacking machine as claimed in claim 1, further comprising a cushioning apparatus having at least one resilient member corresponding to said slideway, for relieving shock force of said strip articles.

6. The auto stacking machine as claimed in claim 5, wherein said cushioning apparatus further comprises a cylinder attached to said plate of said worktable, and a bridge attached to the cylinder, and said resilient member is arranged on the bridge.

7. The auto stacking machine as claimed in claim 6, wherein said resilient member is disposed behind said slideway, said cylinder is controlled by said controller to move said resilient member into or out from said receiving spaces of said receiver.

8. The auto stacking machine as claimed in claim 1, wherein a counter is mounted on said slideway, for counting a number of said strip articles sliding through said slideway.

9. The auto stacking machine as claimed in claim 8, wherein said counter comprises an optical sensor, and said counter sends said number to said controller as a criterion to switch said receiving spaces of said receiver.

10. The auto stacking machine as claimed in claim 1, wherein said slideway is arcuate and defined in a chute, and is covered with a cover.

11. The auto stacking machine as claimed in claim 1, wherein said receiver comprises a plurality of blocks, a plurality of spacing plates, and a shield plate, each of said blocks is arranged between every two neighboring spacing plates such that said receiving spaces are defined therebetween, and said shield plate is arranged as a rear side of said receiver.

12. The auto stacking machine as claimed in claim 11, wherein each of said blocks comprises an inclined side, and a generally V-shaped cutout is defined adjacent a bottom of said side.

13. An auto stacking machine comprising:

a worktable;

at least one slideway being attached to said worktable, said slideway comprising an entrance for receiving workpieces, and an exit;

a receiver being attached to said worktable, the receiver being slideable with respect to said slideway in a first direction, the receiver defining at least two receiving spaces switchably in alignment with the exit of said slideway for receiving said workpieces from said exit end;

a cushioning apparatus being arranged abutting said exit end for cushioning said workpieces, the cushioning apparatus comprising at least one resilient member slideable in a second direction perpendicular to said first direction; and a controller controlling movement of said receiver.

14. The auto stacking machine as claimed in claim 13, wherein said receiver comprises a plurality of blocks, and a plurality of spacing plates, each of said blocks is arranged between every two neighboring spacing plates such that receiving spaces are defined therebetween.

15. A method for stacking strip articles comprising steps of:

providing a plurality of said strip articles;

providing at least one slideway along which said strip articles slide;

providing at least one receiver comprising at least two receiving spaces;

piling up said strip articles in one of said receiving spaces;

providing a counter to count the number of said strip articles entering said one of said receiving spaces;

moving said receiver relative to said slideway to continuously receive said strip articles in another of said receiving spaces when a preset number of said strip articles is reached in said one of said receiving spaces; and taking out the stacked said strip articles from said one of the said receiving spaces.

16. The method as claimed in claim 15, wherein providing a cushioning apparatus to cushion said strip articles before the step of piling up said strip articles in one of said receiving spaces.

* * * * *